US005615598A

United States Patent [19]

Noroy et al.

[11] Patent Number: 5,615,598

[45] Date of Patent: Apr. 1, 1997

[54] JACK WITH FIXED PISTON FOR HANDLING, MOVING AND MANIPULATING A WORKPIECE

[75] Inventors: Jean-Marie Noroy, Marchaux; Franck Roussillon, Pontarlier, both of France

[73] Assignee: Parker Hannifin RAK SA, Annemasse, France

[21] Appl. No.: 493,028

[22] Filed: Jun. 21, 1995

[30] Foreign Application Priority Data

Jun. 21, 1994 [FR] France ..... 94 07851

[51] Int. Cl.[6] ..... F01B 15/02

[52] U.S. Cl. ..... 92/117 A; 92/165 PR; 92/165 R; 92/85 B

[58] Field of Search ..... 92/165 R, 165 PR, 92/88, 77, 85 B, 117 A, 117 R

[56] References Cited

U.S. PATENT DOCUMENTS

| | | | |
|---|---|---|---|
| 817,381 | 4/1906 | Matson | 92/165 R |
| 2,952,218 | 9/1960 | Steffes | 92/92 |
| 3,836,011 | 9/1974 | Sakamoto et al. | 92/165 R |
| 4,361,209 | 11/1982 | Kappenhagen et al. | 92/165 R |
| 4,796,516 | 1/1989 | Horvath | 92/165 R |
| 4,898,080 | 2/1990 | Lieberman | 92/117 A |
| 5,062,357 | 11/1991 | Senior et al. | 92/117 A |
| 5,182,985 | 2/1993 | Gutowski | 92/117 A |
| 5,188,018 | 2/1993 | Trenner . | |
| 5,305,683 | 4/1994 | Gospowski et al. | 92/165 PR |
| 5,311,810 | 5/1994 | Takapa et al. | 92/165 R |
| 5,469,775 | 11/1995 | Stoll et al. | 92/88 |

FOREIGN PATENT DOCUMENTS

| | | | |
|---|---|---|---|
| 0472778B1 | 4/1992 | European Pat. Off. . | |
| 0472778A2 | 4/1992 | European Pat. Off. . | |
| 2566847 | 1/1986 | France . | |
| 2588328 | 4/1987 | France . | |
| 3537124A1 | 4/1987 | Germany . | |
| 1247812 | 10/1989 | Japan | 92/88 |
| 2156434 | 9/1985 | United Kingdom . | |

*Primary Examiner*—Thomas E. Denion
*Attorney, Agent, or Firm*—Christopher H. Hunter

[57] ABSTRACT

A jack consists of a body of the jack (2) sliding on a fixed piston (9) mounted on a support (6) by means of a piston rod (4), and at least one element for guiding the body on the support. The body of the jack is an extruded section (2) containing at least one longitudinal bore (3) used as the piston chamber for the jack, and equipped with at least two guide rods (5) mounted on the section (2) in the longitudinal direction. Bearings (15) adapted to the shape of the guide rods (5) are mourned on the fixed support (6). At least one of the bearings is adjustable. Advantageously, the extruded section (2) is equipped with two hydraulic shock absorbers intended to contact limit stops (21). Limit stops (21) have adjustable positions, and can be retracted and fixed on an L-shaped groove (20) of the fixed support (6).

37 Claims, 3 Drawing Sheets

JACK WITH FIXED PISTON FOR HANDLING, MOVING AND MANIPULATING A WORKPIECE

FIELD OF THE INVENTION

The present invention relates generally to guided jacks having a fixed piston.

BACKGROUND OF THE INVENTION

Jacks with a fixed piston are known for handling, moving and manipulating workpieces. In this type of jack, the body of the jack moves in relation to the piston, and a guiding element is provided to ensure the longitudinal motion of the body and to prevent rotation between the piston and the body. Such a jack is also advantageously used in handlers and robots.

Patents FR 2 566 847 and FR 2 588 328 held by the applicant, describe a jack with a fixed piston, in which the body of the jack consists of a tube sliding on the fixed piston. A guiding element is also provided. The guiding element is installed parallel to the body of the jack and is held in place by blocks. The guiding element is connected to the body of the jack through a connecting piece of an appropriate shape. To reduce the overall dimensions, the guiding element remains inside the casing when the body of the jack moves outward.

The inconvenience of this type of jack is that the body of the jack is a tubular part, ill-adapted to form the arm of a robot and to be equipped with a tool because of its shape, and also because of its mechanical resistance. In addition, there are difficulties in manufacturing the body of the jack.

Further, the guiding of the body of the jack is bulky and its fabrication cost is high. While other known guiding systems might allow a shorter length, the width and height can still be substantial, i.e., in the traverse directions of the jack movement.

It can also be desirable to be able to stop the jack movement, before it reaches its end of travel. This stop should take place both on the occasion of an outward movement and during the return of the body of the jack.

Patent FR 2 588 328, mentioned above, describes a jack which makes it possible to obtain intermediate stops. For this purpose, the jack contains a reversible screw which is also used as the guiding element. The length of the screw is approximately equal to the total travel of the jack and is equipped with a blocking component to stop the rotation of the screw for a given travel of the body of the jack. The blocking component is activated by sensors or by a rotating coder. This device is electrical and its realization cost is high.

As shown in Patent EP-B-0 472 778, it is also known to stop the arm of a jack-activated handler during its movement by placing an adjustable limit stop in a "T" shaped groove of the handler arm. In this jack, the handler is provided with a double-effect jack controlling the movement of a shock absorber. The double-effect jack retracts to intercept the limit stop to stop movement of the handler arm. However, this device only allows a small adjustment range at the end of travel of the jack, and the stop can only occur when the rod moves outward. In addition, three shock absorbers are necessary: (i) one for the limit stop at the end of travel of the handler arm, (ii) one at the end of travel of the withdrawal, and (iii) one for the intermediate stop.

As such, it is believed there is a demand in the industry for an improved guided jack with fixed piston for handling, moving and manipulating workpieces.

SUMMARY OF THE INVENTION

The jack of the present invention consists of a body sliding on a fixed piston. The piston is installed on a support by means of a piston rod. The body of the jack is an extruded section with at least one longitudinal bore to receive the piston, and equipped with at least two guide rods mounted longitudinally on the extruded section to guide the body on the support. Bearings adapted to the shape of the guide rods are mounted on the fixed support. The bearings cooperate with the guide rods to support the extruded section of the jack for sliding in the longitudinal direction and prevent rotation thereof. At least one of the bearings is adjustable such as by a cam.

According to the present invention, the extruded section of the jack, which forms, for example, a moveable component such as the arm of a robot, is at the same time the driving element, since it includes the piston chamber for the jack as well as the guiding and anti-rotation element for the body of the jack.

In addition, the overall dimensions of the jack are kept to a minimum. On one hand, the driving element is integrated into the moveable component. The cylinder wall of the jack body is used both as the leaktight wall for the piston chamber of the jack, as well as a support for a tool or accessory. On the other hand, since the guide rods are mounted on the extruded section, the space necessary to ensure the guiding function can be reduced to a minimum as it is enough to have space for the bearings only. Further, the use of at least two guide rods makes it possible to combine their guiding function with the anti-rotation function.

In order to reduce the overall dimensions and to effectively ensure the anti-rotation function, the guiding elements are rods of circular section, partly furred-up (embedded) in the extruded section, on opposite surfaces of the extruded section.

In certain applications, the extruded section can carry a tool at the end. This tool can require an electrical, pneumatic or hydraulic supply. To facilitate the supply, the extruded section contains two parallel longitudinal bores, one of which is used as the piston chamber in the body of the jack. Besides being used to supply power to a tool, the other bore can be used to house a return spring or a gas-activated shock absorber. This way, when the jack is working in a vertical position with the extruded section protruding from the jack at the bottom, the spring or shock absorber will return the extruded section to a withdrawn (non-extended) position for safety reasons in case of power supply failure of the jack.

The second bore in the extruded section can also be used, for example, as a second piston chamber for the jack. In this case, the jack has two parallel piston chambers. The jack power is therefore doubled.

The guided jack with fixed piston described above also makes it possible to perform intermediate stops along the travel of the section. To this end, two hydraulic shock absorbers are attached to the extruded section, one to absorb the shocks in the outward direction of the extruded section, and the other in its re-entry (withdrawn) direction.

Advantageously, the extruded section is guided over an "L" shaped support, to which is connected the fixed piston. Guiding bearings are mounted on the "L" shaped section for support of the piston. For intermediate stops, each branch of the "L" has a longitudinal groove which can receive at least one limit stop with adjustable position. Each limit stop is situated on the path of one of the shock absorbers integral with the section. The support can be open to external view and does not have to be a closed box. The accessibility to various components of the jack is thereby improved. The space gain and the weight reduction of the jack are also substantial.

Advantageously, each limit stop is mounted on a limit stop jack having an orthogonal axis to the translation direction of the extruded section. Each limit stop can be moved between a position in which the limit stop is situated on the path of a shock absorber, and a position in which the limit stop is retracted. This way, the shock absorbers move with the extruded section and contact the limit stops to thereby absorb the shock when a stop is required. Otherwise, the shock absorbers pass a retracted limit stop(s) without contact.

The jack used for each limit stop can be, for example, a simple-effect jack withdrawn by a spring. However, this jack is preferably a double-effect jack whose retractable, prism-shaped body which forms the limit stop is guided into a block.

To be able to integrate the jack with fixed piston in an automated system, it is necessary to determine the position of the extruded section used as the body of the jack and, especially, to determine the position of the extruded section at an intermediate stop. For this purpose, a sensor is placed near each movable limit stop to detect the presence or absence of a shock absorber. For better control, at the level of each jack controlling a movable limit stop, a first sensor controls the withdrawn position of the limit stop and a second sensor controls the protruding position of the limit stop.

As described above, the invention will be well understood with the help of the following description, in reference to the schematic drawings attached hereto which show, as a non-restrictive example, one form of execution of a jack with fixed piston according to the invention.

DETAILED DESCRIPTION OF THE PREFERRED EMBODIMENT

Figure 1:
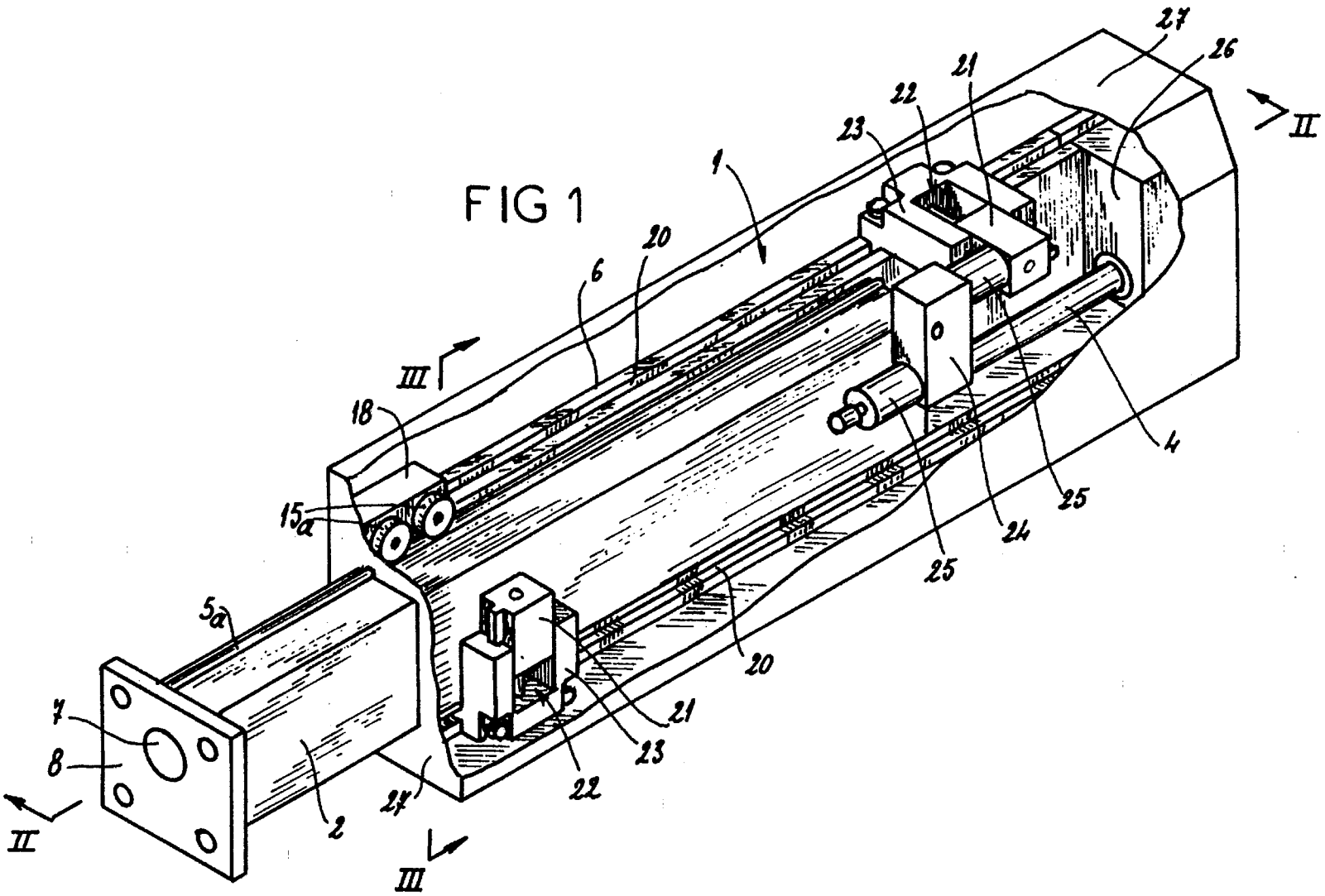
FIG. 1 is a perspective view of the invention.
Figure 2:
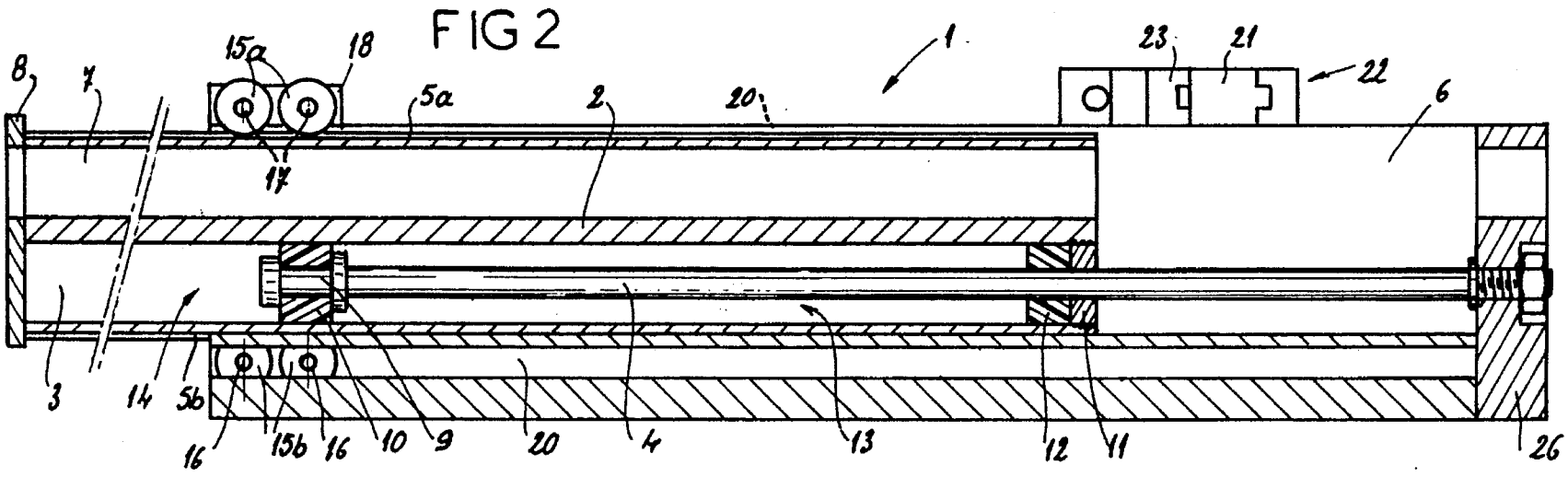
FIG. 2 is a longitudinal sectional view according to line II—II in FIG. 1.

FIGS. 1–4 illustrate a jack 1 constructed according to the principles of the present invention. Jack 1 consists of a body having an extruded section 2, which is slidable on a fixed piston 9. Extruded section 2 on piston 9 is guided by guide rods 5. The assembly of the extruded section 2 and piston 9 is mounted on a support 6.

Section 2 is made of extruded aluminum. The cross-section of the extruded section is approximately rectangular and has two parallel bores 3, 7 extending longitudinally from one end to the other of the section. The first bore 3 is used as a piston chamber, and receives the fixed piston 9. The second bore 7 makes it possible to have a lighter section 2. In addition, in the example shown in FIG. 2, the extruded section 2 is intended to be equipped with a tool and to this end, a tool holder plate 8 is mounted at its extremity. Bore 7 can then serve as a conduit for supplying electricity and/or pressure fluid to the tool.

The fixed piston 9, on which slides the extruded section 2, includes a piston rod 4 and is equipped with gaskets 10.

Piston 9 defines two chambers in bore 3 which pneumatic pressures will be sequentially admitted. One chamber 13 is defined in the rear of the bore (to the right in FIG. 2) and one chamber 14 is defined in the front of the chamber (to the left in FIG. 2). Pressure is supplied to the chambers by components not shown on the figures. The rear end 11 of chamber 13 is made leaktight by gaskets 12.

On the upper and lower surfaces of section 2 are two cylindrical guide rods **5*a*, 5*b* made of steel which are at least partially furred-up (i.e, embedded) in the section. Through these rods, the extruded section 2 is guided with regard to the support 6 on upper and lower guide rollers 15*a*, 15*b* (See FIG. 3). The lower rollers 15*b* working together with the lower guide rod 5*b* are mounted on axle 16. The head of axle 16 is imbedded in a countersunk hole in the support 6, while its other extremity is screwed onto support 6**.

The upper rollers **15*a* working together with the upper guide rod 5*a* are rotatably mounted on an eccentric cam 17 to support block 18. Support block 18 is mounted on the support 6. The head of cam 17 is imbedded in block 18. The other end of the cam 17 is threaded and screwed in the block 18. Cam 17 is provided with an internal hex socket which allows the adjustment of the rollers by turning the cam, such that rollers 15*a*, exert a preload on the guide rod 5*a*. Once the adjustment is obtained, a lock nut 19 makes it possible to lock cam 17** in the selected position.

The guide rods **5*a*, 5*b* work together with the upper and lower guide rollers 15*a*, 15*b* to guide the section 2, in transition, with regard to the support section 6. Rods 5*a*, 5*b* also fulfill the anti-rotation function. Taking into consideration their position on two opposite surfaces of section 2**, the rotation of the latter around the longitudinal translation axis is prevented.

The support 6 is a support section having an "L" shaped cross-sectional configuration. Each branch of the "L" has a groove 20. Blocks 18 used as support for upper rollers **15*a* are mounted on the upper one of these grooves (as viewed in FIG. 3**).

Limit stops 21 are also mounted in grooves 20 on the support 6. Stops 21 are mounted on a double-effect jack 22 and guided in a block 23 with the help of a sliding connection.

On extruded section 2 is attached a support 24 for two self-adjusting hydraulic shock absorbers 25. The shock absorbers are mounted parallel to the axis of section 2. One of them is oriented to absorb the shocks when it meets an obstacle in the outward direction of the section 2, and the other one absorb the shocks in the withdrawal direction of section 2.

Each shock absorber 25 is mounted so that, when limit stops 21 situated on the corresponding groove 20 are in the protruding position, the shock absorbers collide with these limit stops during the travel of extruded section 2. Conversely, when these limit stops 21 are in the withdrawn position, the shock absorbers pass in front of the limit stops 21 without collision.

Shock absorbers 25 are also used to absorb the shock at the end of travel of extruded section 2. They collide in one direction with a plate 26, to which the piston rod 4 is also attached, and in the other direction with a casing 27. Plate 26 and casing 27 are both attached to the support section 6.

Limit stops 21 can be placed so that section 2 can stop, both in the outward direction of section 2 and in the withdrawn direction of section 2, in any one (or several) intermediate position.

The "L" shape of support 6 is very advantageous, since it allows accessibility to the limit stops 21. It is enough to remove casing 27 to immediately gain direct access to limit stops 21 and to all the other components of the jack.

Figure 4:
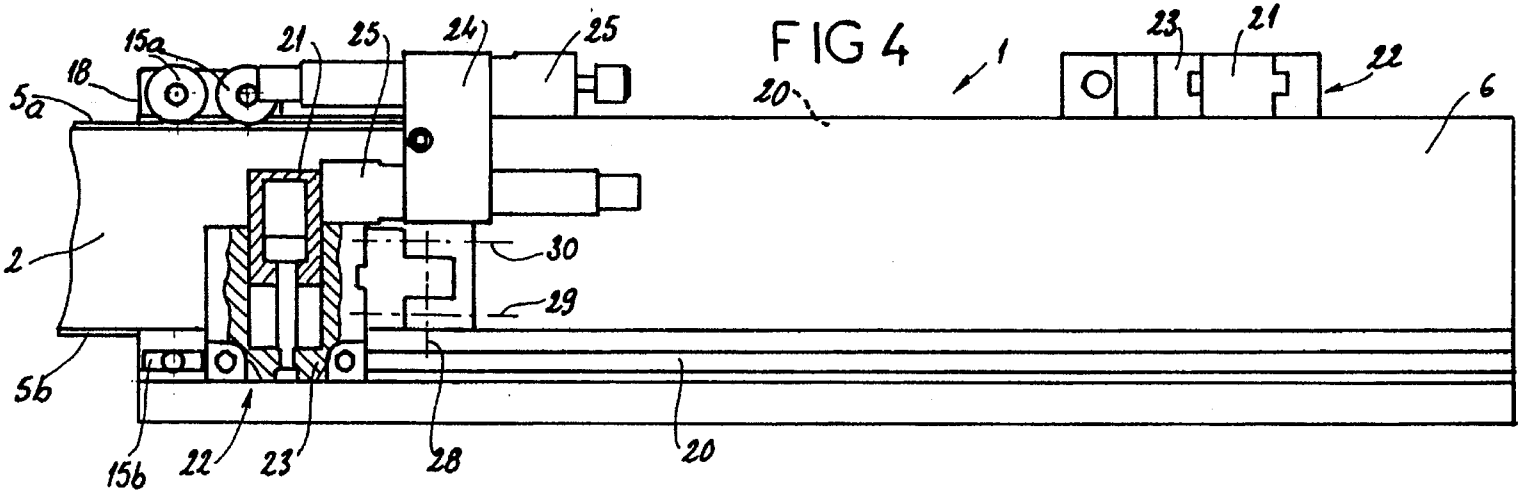
FIG. 4 is a side view of the jack according to the invention.
Figure 3:
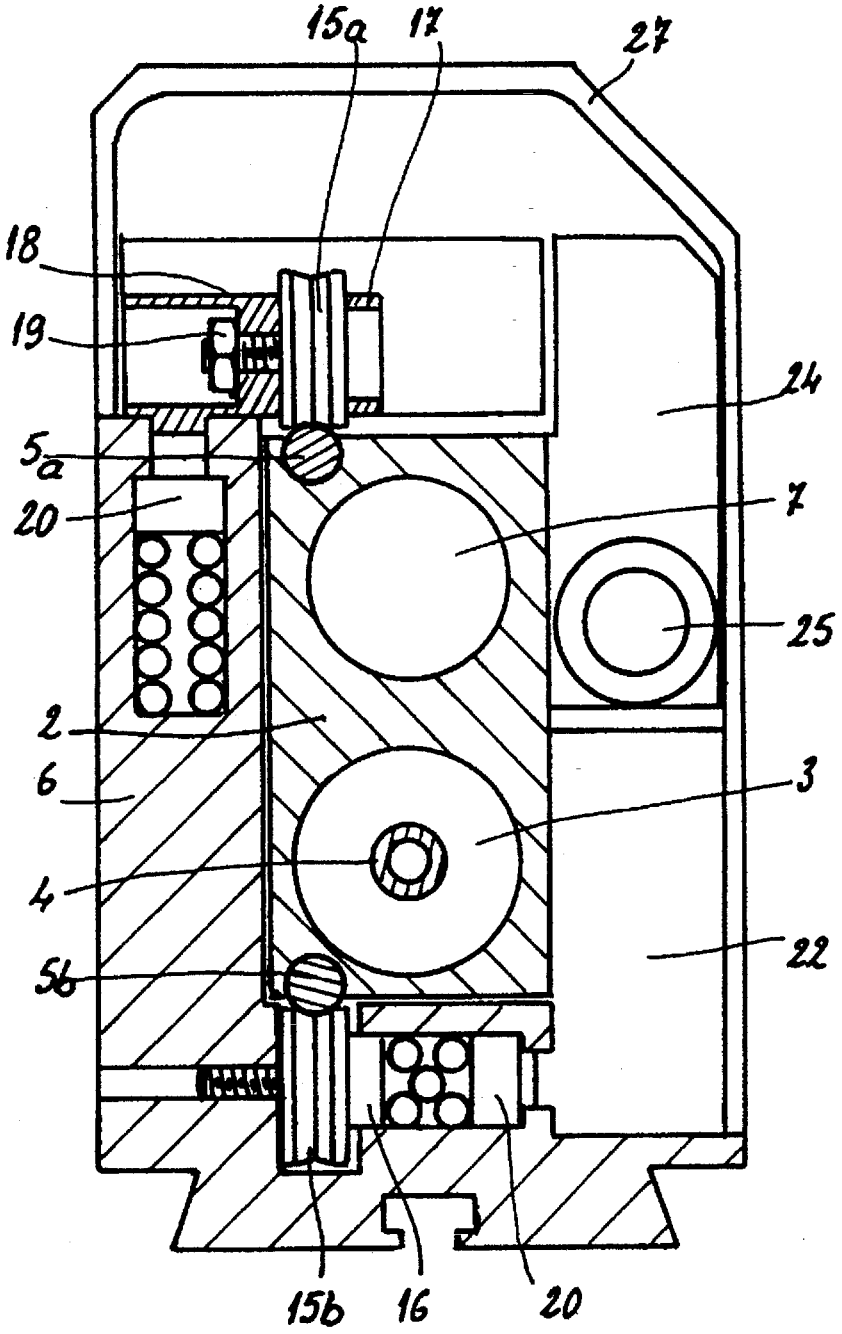
FIG. 3 is a cross-sectional view according to line III—III in FIG. 2, at an enlarged scale.

When the jack 1 is integrated in an automated assembly, it is necessary to determine the position of section 2 and that of the limit stops 21. Sensors (not shown) are in this case provided. A first sensor—for example a PNP or NPN inductive sensor—makes it possible to detect the presence of support 24 of the shock absorbers near a limit stop 21. The sensor can be placed on the axis 28 (FIG. 4). A second sensor placed on the axis 29 detects if the limit stop 21 is withdrawn, while a third sensor, placed on axis 30, detects if the limit stop 21 is protruding. The information given by these sensors is then sent to a central control unit which manages the automated assembly to which the jack 1 is integrated.

Of course, variations on the structure of the jack described above are contemplated. For example, the section constituting the body of the jack does not necessarily have a parallel-piped shape, but it can have, for example, another prismatic shape. In the same way, the second bore 7 inside the extruded section 2 used to supply power to a tool can have other functions than the one described in the example above.

The second bore 7 can also be used to hold a spring or a gas-activated shock absorber, which returns the extruded section to the withdrawn (non-extended) position. This way, in case of power supply failure of the jack, the section is automatically withdrawn. This is in general the position in which there is the least risk of collision.

In order to double the jack power, the second bore 7 can be used, like the first one, as a piston chamber for the jack. In this case, the body of the jack slides on a second fixed piston, also connected to the support 6. Of course, the section can have a third piston and a third bore for a third piston chamber, if necessary, parallel to the other two, to further increase the power of the jack.

In addition, as described earlier, the guide rods 5*a*, 5*b* are partly furred-up (embedded) in the extruded section 2. Non furred-up rods are also acceptable. In this case, the overall dimensions of the jack would be larger, but the guiding and anti-rotation function of the rods are maintained.

Further, the several limit stops can be placed in the same groove of the support section (i.e., in the upper or lower groove 20). For reasons of clarity of the drawing, only one limit stop per groove is illustrated. These limit stops are controlled by double-effect jacks. A simple-effect jack, withdrawn by spring, is also acceptable.

Also, three sensors per limit stop are provided to control the position of the section and that of the limit stop. Depending on the applications, the number of sensors can be reduced (or increased).

As described above, the present invention thereby provides a jack with a fixed piston for handling, moving or manipulating a workpiece, consisting of a guiding and anti-rotation system of reduced overall dimensions and made with few elements. The jack guarantees high precision, which makes it possible to perform intermediate stops through the entire length of the travel of the body of the jack, both when moving outward and when withdrawing.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. An apparatus, comprising:

a jack body sliding on a fixed piston, said piston being mounted on a fixed support by means of a piston rod, the jack body having an extruded section containing at least one longitudinal bore used as a piston chamber for the piston of the jack, and having at least two guide elements mounted on the body in the longitudinal direction for guiding the body on the support, said jack further including bearings corresponding to a shape of the guide elements, at least one of said bearings being adjustable and being mounted on the fixed support.

2. The apparatus according to claim 1, wherein the guide elements are cylindrical rods, said rods being at least partly embedded in the extruded section on two of the surfaces of the extruded section.

3. The apparatus according to claim 2, wherein the extruded section contains two longitudinal parallel bores, at least one of which is used as the piston chamber for the jack.

4. The apparatus according to claim 3, wherein two hydraulic shock absorbers are attached to the extruded section, one of which absorbs the shocks in the outward direction of travel of the section, and the other of which absorbs the shocks in the withdrawal direction of travel of the section.

5. The apparatus according to claim 4, wherein the extruded section is guided on an "L" shaped support, said "L" shaped support being connected to the fixed piston.

6. The apparatus according to claim 1, wherein two hydraulic shock absorbers are attached to the extruded section, one of which absorbs the shocks in the outward direction of travel of the section, and the other of which absorbs the shocks in the withdrawal direction of travel of the section, and the extruded section is guided on an "L" shaped support, said "L" shaped support being connected to the fixed piston, and each branch of the "L"-shaped support has a longitudinal groove which receives at least one adjustable position limit stop, said at least one adjustable position limit stop being situated on the path of one of the shock absorbers integral with the extruded section.

7. The apparatus according to claim 6, wherein each limit stop is mounted on a limit stop jack such that the geometric axis of the limit stop jack extends along an orthogonal axis to the translation direction of the extruded section, and is adjustable between a position in which the limit stop is protruding and is situated in the path of a shock absorber and a position in which the limit stop is retracted and is out of the path of the shock absorber.

8. The apparatus according to claim 7, wherein the jack used for each limit stop is a double-effect jack, the retractable body of which constitutes the limit stop and has a prismatic shape, said retractable body being guided into a block of the limit stop jack.

9. The apparatus according to claims 8, wherein a sensor is placed proximate each movable limit stop in order to detect the presence or absence of a shock absorber.

10. The apparatus according to claim 7 wherein at the level of each jack controlling a movable limit stop, a first sensor checks the retracted position of the limit stop and a second sensor checks the protruding position of the limit stop.

11. The apparatus as in claim 1, wherein said piston rod extends through one end of said extruded section, and a tool plate is provided on another end of said extruded section for mounting a tool.

12. The apparatus as in claim 1, wherein said extruded section includes a central, longitudinally-extending axis, and a pair of outwardly-facing upper and lower side surfaces disposed on opposite sides of said axis, one guide element being mounted on each side surface and projecting outwardly away from said extruded section.

13. The apparatus as in claim 2, wherein said bearings include rollers for sliding engagement with the cylindrical rods, with one of the bearings being mounted on an adjustable cam.

14. The apparatus as in claim 1, wherein said guide members each comprise a guide rod mounted to said exterior surface of said extruded section, and said bearings each comprise a guide roller in contact with a respective guide rod, with one of said guide rollers being eccentrically mounted for adjusting the relative positioning of the guide roller and the respective guide rod.

15. The apparatus as in claim 14, wherein said extruded section includes a central, longitudinally-extending axis, and a pair of outwardly-facing upper and lower side surfaces disposed on opposite sides of said axis, one guide element being mounted on each side surface and projecting outwardly away from said body.

16. The apparatus as in claim 5, wherein the L-shaped support has a first branch extending along a first surface of the extruded section and a second branch extending along a second surface of the extruded section, orthogonal to said first surface, one of said branches having a longitudinally-extending first groove for receipt of a first limit stop.

17. The apparatus as in claim 16, wherein the other of said branches of said L-shaped support includes a longitudinally-extending second groove for receipt of second limit stop.

18. The apparatus as in claim 17, further including a shock absorber mounted to said extruded section for contacting at least one of said limit stops during movement of said extruded portion.

19. A guided jack with fixed piston, comprising:

a fixed support, a piston mounted to the support and fixed with respect thereto, a jack body sliding on the fixed piston in the longitudinal direction of the piston in a outward direction of travel away from the fixed support, and a withdrawal direction of travel toward the fixed support, said jack body having an extruded section containing at least one longitudinal bore receiving the piston, and having two guide elements mounted on the body in the longitudinal direction, and further including bearings mounted on the fixed support and in contact with the guide elements to slidingly support the jack body and prevent rotation thereof, at least one of said bearings being adjustable to urge said at least one bearing against one of the guide elements.

20. The guided jack as in claim 19, wherein said extruded section of said jack body has an upper side surface and an oppositely facing lower side surface, one of said guide elements being mounted on said upper side surface and the other of said guide elements being mounted on said lower side surface.

21. The guided jack as in claim 20, wherein said extruded section includes a pair of longitudinal bores forming a pair or chambers, said piston extending away from said support through an aperture in a gasket sealing an end of one of said chambers and into said one chamber.

22. The guided jack as in claim 21, wherein two hydraulic shock absorbers are attached to the extruded section, one of which absorbs the shocks in the outward direction of travel of the section, and the other of which absorbs the shocks in the withdrawal direction of travel of the section.

23. The guided jack as in claim 22, wherein said fixed support includes a longitudinal groove and a position limit stop is mounted in the longitudinal groove, the location of said position limit stop being adjustable in the longitudinal direction along the length of the longitudinal groove.

24. The guided jack as in claim 19, wherein two hydraulic shock absorbers are attached to the extruded section, one of which absorbs the shocks in the outward direction of travel of the section, and the other of which absorbs the shocks in the withdrawal direction of travel of the section, and said fixed support includes a longitudinal groove and a position limit stop is mounted in the longitudinal groove, the location of said position limit stop being adjustable in the longitudinal direction along the length of the longitudinal groove, said limit stop is mounted on a limit stop jack such that the geometric axis of the limit stop jack extends along an axis orthogonal to the translation direction of the extruded section, and is adjustable between a position in which the limit stop is extended and situated in the path of one of the shock absorbers and a position in which the limit stop is retracted and is out of the path of the shock absorber.

25. The guided jack as in claim 19, wherein said piston extends through one end of said extruded section, and a tool plate is provided on another end of said extruded section for mounting a tool.

26. The guided jack as in claim 20, wherein said upper and lower side surfaces face outwardly away from said body, and said guide elements project outwardly, away from said body.

27. The guided jack as in claim 26, wherein said extruded section further includes a pair of outwardly-facing left and right side surfaces, with each left and right side surface extending between and interconnecting said upper and lower side surfaces.

28. The guided jack as in claim 19, wherein said bearings comprise a pair of guide rollers in contact with said guide elements, with each of said guide rollers contacting a respective guide element.

29. The guided jack as in claim 28, wherein one of said bearings is mounted on an adjustable cam.

30. The guided jack as in claim 20, wherein said extruded section also has a left side surface and a right side surface, both of which interconnect the upper side surface and the lower side surface, and said fixed support has an L-shaped cross-sectional design, with a first branch of said support extending along said left side surface of said extruded section and another branch of said support extending along said lower side surface of said extruded section, one of said branches having a longitudinally-extending first groove for receipt of a first limit stop.

31. The guided jack as in claim 30, wherein the other of said branches of said fixed support includes a longitudinally-extending second groove for receipt of a second limit stop.

32. The guided jack as in claim 31, further including a shock absorber mounted to said extruded section for contacting at least one of said limit stops during movement of said extruded portion.

33. A guided jack with fixed piston, comprising:

a fixed support, a piston mounted to the support and fixed with respect thereto, a jack body and sliding on the fixed piston in the longitudinal direction of the piston in a outward direction of travel away from the fixed support, and a withdrawal direction of travel toward the fixed support, said jack body having an extruded section containing an exterior surface with a pair of longitudinally-extending upper and lower side surfaces and a pair of longitudinally-extending left and right side surfaces interconnecting the upper and lower side surfaces, a tool plate one an end of said extruded section, and at least one bore extending longitudinally within said extruded section and having an opening at another end of said extruded section receiving said piston, and a pair of guide elements mounted on the exterior surface of the body and extending in the longitudinal direction, with one guide element on said upper side surface and the other guide element on said lower side surface, and further including a pair of bearings mounted on the fixed support in contact with the guide elements to slidingly support the jack body between the bearings and prevent rotation thereof, at least one of said bearings being adjustable to urge said at least one bearing against one of the guide elements.

34. The guided jack as in claim 33, wherein two shock absorbers are attached to the extruded section, one of which absorbs the shocks in the outward direction of travel of the section and the other of which absorbs the shocks in the withdrawal section of travel of the section, and said fixed support includes a longitudinal groove and a position limit stop is mounted in the longitudinal groove, the location of the position limit stop being adjustable in the longitudinal direction along the length of the longitudinal groove, said limit stop is mounted such that the limit stop is situated in the path of one of the shock absorbers.

35. The guided jack as in claim 34, wherein said limit stop is mounted on a limit stop jack such that the geometric axis of the limit stop jack extends along an axis orthogonal to the translation direction of the extruded section, and is adjustable between a position in which the limit stop is extended and is situated in the path of one of the shock absorbers and a position in which the limit stop is retracted and is out of the path of the one shock absorber.

36. An apparatus, comprising:

a jack body sliding on a fixed piston, said piston being mounted on a fixed support by means of a piston rod, the jack body having an extruded section containing two longitudinal parallel bores, at least one of which is used as a piston chamber for the jack, wherein the extruded section is guided on an "L" shaped support, said "L" shaped support being connected to the fixed piston, and having at least two guide elements mounted on the body in the longitudinal direction for guiding the body on the support, said guide elements being cylindrical rods, said rods being at least partly embedded in the extruded section on two of the surfaces of the extruded section, said jack further including bearings corresponding to a shape of the guide elements, at least one of said bearings being adjustable and being mounted on the fixed support, and two hydraulic shock absorbers attached to the extruded section, one of which absorbs the shocks in the outward direction of travel of the section, and the other of which absorbs the shocks in the withdrawal direction of travel of the section, each branch of the "L"-shaped support having a longitudinal groove which receives at least one adjustable position limit stop, said at least one adjustable position limit stop being situated on the path of one of the shock absorbers integral with the extruded section.

37. A guided jack with fixed piston, comprising:

a fixed support, a piston mounted to the support and fixed with respect thereto, a jack body sliding on the fixed piston in the longitudinal direction of the piston in a outward direction of travel away from the fixed support, and a withdrawal direction of travel toward the fixed support, said jack body having an extruded section containing said extruded section includes a pair of longitudinal bores forming a pair or chambers, said piston extending away from said support through an aperture in a gasket sealing an end of one of said chambers and into said one chamber, and having two guide elements mounted on the body in the longitudinal direction, said extruded section of said jack body has an upper surface and an oppositely facing lower surface, one of said guide elements being mounted on said upper surface and the other of said guide elements being mounted on said lower surface, and further including bearings mounted on the fixed support and in contact with the guide elements to slidingly support the jack body and prevent rotation thereof, at least one of said bearings being adjustable to urge said at least one bearing against one of the guide elements and two hydraulic shock absorbers are attached to the extruded section, one of which absorbs the shocks in the outward direction of travel of the section, and the other of which absorbs the shocks in the withdrawal direction of travel of the section and said fixed support includes a longitudinal groove and a position limit stop is mounted in the longitudinal groove, the location of said position limit stop being adjustable in the longitudinal direction along the length of the longitudinal groove and said limit stop is mounted on a limit stop jack such that the geometric axis of the limit stop jack extends along an axis orthogonal to the translation direction of the extruded section, and is adjustable between a position in which the limit stop is extended and situated in the path of one of the shock absorbers and a position in which the limit stop is retracted and is out of the path of the shock absorber.

* * * * *